US010472852B2

(12) United States Patent
Rosario

(10) Patent No.: US 10,472,852 B2
(45) Date of Patent: Nov. 12, 2019

(54) ADJUSTABLE AND RACKABLE FENCE SYSTEM

(71) Applicant: Harry Rosario, Fort Worth, TX (US)

(72) Inventor: Harry Rosario, Fort Worth, TX (US)

( * ) Notice: Subject to any disclaimer, the term of this patent is extended or adjusted under 35 U.S.C. 154(b) by 545 days.

(21) Appl. No.: 15/097,267

(22) Filed: Apr. 12, 2016

(65) Prior Publication Data

US 2017/0292288 A1 Oct. 12, 2017

(51) Int. Cl.
*E04H 17/14* (2006.01)

(52) U.S. Cl.
CPC ..... *E04H 17/1421* (2013.01); *E04H 17/1426* (2013.01); *E04H 2017/1447* (2013.01)

(58) Field of Classification Search
CPC ..... E04H 17/1417; E04H 17/1421; E04H 17/1408; E04H 17/1426; E04H 17/143; E04H 17/1434; E04H 2017/1447; E04H 2017/1452; E04H 2017/1491
USPC ..... 256/19, 59, 65.01, 65.03, 65.04, 67
See application file for complete search history.

(56) References Cited

U.S. PATENT DOCUMENTS 2,346,111 A * 4/1944 MacKenzie ..... 160/161
3,561,792 A * 2/1971 Cycowicz ..... F16B 5/04 403/145
3,960,367 A * 6/1976 Rogers ..... E04H 17/1434 256/21
5,033,900 A * 7/1991 Pine ..... F16B 5/04 403/146
5,125,194 A * 6/1992 Granger ..... E01F 9/685 403/2
5,601,278 A * 2/1997 Graber ..... E04H 17/143 256/19
6,029,954 A * 2/2000 Murdaca ..... E04F 11/1834 256/59
6,802,496 B1 * 10/2004 Preta ..... E04H 17/1413 16/253
2010/0288989 A1 * 11/2010 Williams ..... E04H 17/143 256/59

FOREIGN PATENT DOCUMENTS

DE 295 01 907 * 7/1995 ..... E04H 17/00
EP 0 293 337 * 5/1988 ..... E04H 17/14

* cited by examiner

*Primary Examiner* — Michael P Ferguson
(74) *Attorney, Agent, or Firm* — Frank Pham; Pham IP Group

(57) ABSTRACT

An improved method and apparatus for a fence system that is adjustable and rackable to accommodate uneven surfaces. The picket fence system can be adjusted into a selected position and releasably secured, or portions can be changed to modify the appearance of the fence. One embodiment of the invention provides rackable fencing in panel to allow for easily moving selected fences in racks.

6 Claims, 7 Drawing Sheets

ADJUSTABLE AND RACKABLE FENCE SYSTEM

BACKGROUND OF THE INVENTION

1. Field of the Invention

The field of the invention relates to improvements in fencing, and more particularly relates to improved apparatus and method of a picket fence system that allows the function and uses of the system to be selectively adjustable and rackable to meet varying conditions of uneven surfaces and uses. The present invention is particularly suitable for use and replacement of current fencing systems and other outdoor structures constructed from wooden materials.

2. Description of the Prior Art

Picket fencing is commonly used in private locations to provide security by barring entry to the enclosed locations, to provide privacy, or to improve the aesthetic appearance of the area. Most current picket fence system has a fixed structural design and construction. The fence remains permanently in essentially the same condition of appearance and use after it is installed in the desired location. Expensive and time consuming maintenance is often required to preserve the original condition of the fence. Any substantial change in the function, use or appearance of the fence usually requires laborious activity such as reconstruction or painting. These fence constructions are not adaptable for performing changeable functions or adjustable to provide the fence with flexibility of selected conditions.

Further, the arrangement and appearance of the current picket fencing are particularly static or difficult to change when the fence is constructed of wooden materials and the like, a type of fencing that is becoming increasingly more prevalent. The construction of wooden fence typically requires heavily laborious activities, such as by assembling each picket to the fence rails. Moreover, major changes or replacement in construction or design of the wooden fence would require costly changes to remove the old structures and to create the different parts of a fence. The cost of storing or inventorying the number of different component parts having different functions or appearances is also very substantial.

The color and appearance of these wooden fence or outdoor structures are not weather resistance and difficult to change. Wooden materials are susceptible to degradation in sunlight due to the effect of ultraviolet rays. Some of disadvantages also arise with these wooden fences and outdoor structures, such as fence rails or pickets that are constantly exposed to weather resulting in cracks or splits. Substantial costs would also be involved in attempting to repair or replace theses fences or outdoor structures.

A need exists in the art for a picket fence system that is adjustable and rackable to overcome the above problems.

SUMMARY OF THE INVENTION

The present invention provides an improved method and apparatus of construction and use for a picket fence system that allows the fence to be readily adapted to any pitch or degree of surface terrain to vary the use or appearance of the fence.

In a preferred embodiment of the present invention, the fence would perform a dynamic function that allows the fence to be adjustable in uneven surface areas, but still provides privacy or barring entry to an area. With this invention the fence system is readily adapted for additional features or functions and can be changed or adjusted easily for a different appearance or use.

In another preferred embodiment, the fence incorporating this invention can be adapted or adjusted selectively to adapt to changes in weather, to vary viewing or privacy conditions, to enhance security, to accommodate changes in surface terrain, and to permit other desired adjustments or changes. The adjustable components of the fence can be releasably locked into fence posts after the desired adjustment is made.

In another preferred embodiment of the present invention, the improved picket fence system provides a readily assembled picket fence in panels for facilitating the construction of the fence. The fence further includes an attachment feature that allows other components such as support structures to be easily attached.

In another preferred embodiment, the present invention further provides apparatus and methods to readily change the appearance of the fence to suit particular needs or desires. The pickets, railing or post components can be varied after installation by changing the color, texture or other appearance at a low-cost and efficient manner. By utilizing metal materials for manufacturing the pickets, fence rails and posts, the fence can be changed from the traditional wooden fencing to wood texture and embossing colors on the metal fencing. Changes in the appearance of the fence can be done to accommodate the changes in weathers, to match or coordinate with the colors of other structures such as adjacent houses, to improve visibility or safety, or to suit other needs or desires of the user.

In another preferred embodiment, the present invention relates to a method for a picket fencing system that is capable of adjustment to vary the conditions of use. When used as a fence, the system includes fence rails and posts for supporting a portion of the fence and movable fence pickets. Supporting structure supports the fence pickets on the rails and allows them to be selectively adjusted to a plurality of positions.

In another preferred embodiment, the present invention provides a method for altering or modifying the appearance of the pickets, fence rails and posts. Each of the fence pickets includes a support structure connected to the fence rails to construct fence panels. These separate fence panels having a selected appearance or color are rackable with locking elements to be releasably locked into the fence posts. The fence panels in accordance with this invention further can define a method which is readily assembled for the construction of fencing.

Further objects and advantages of the present invention will become apparent from a description of the several embodiments as set forth in the following description and drawings.

DETAILED DESCRIPTION OF THE INVENTION

Figure 1:
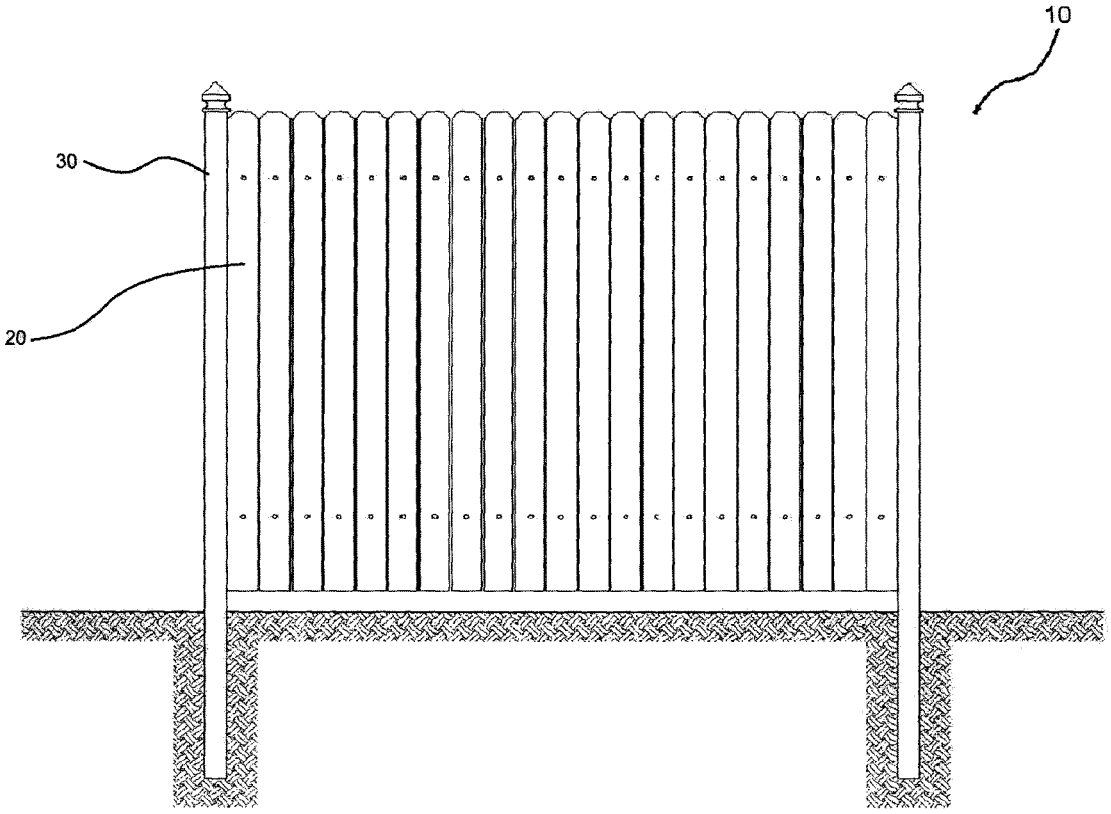
FIG. 1 is a front elevational view of a portion of a fence according to an embodiment of the invention.

FIG. 1 illustrates a front elevational view of a portion of a fence 10 constructed in accordance with the present invention. The fence 10 includes vertical supporting fence posts 30 and top and fence pickets 20. End caps are placed on the upper ends of the supporting fence posts 30. In the preferred embodiments these components of the fence 10 are hollow and can be constructed from recyclable metal materials such as galvanized steel, galvannealed steel, galvalume steel, aluminum, and stainless steel. The metal members can be wood textures or embossing, and the like.

Figure 2:
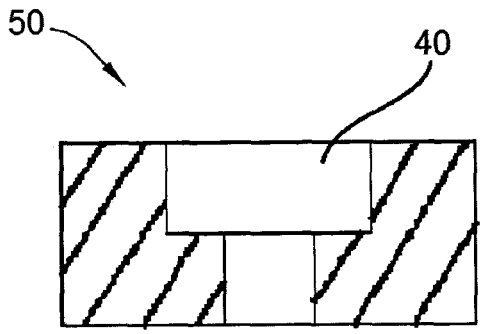
FIG. 2 is a cross-sectional view of an embodiment for a support structure.
Figure 3:
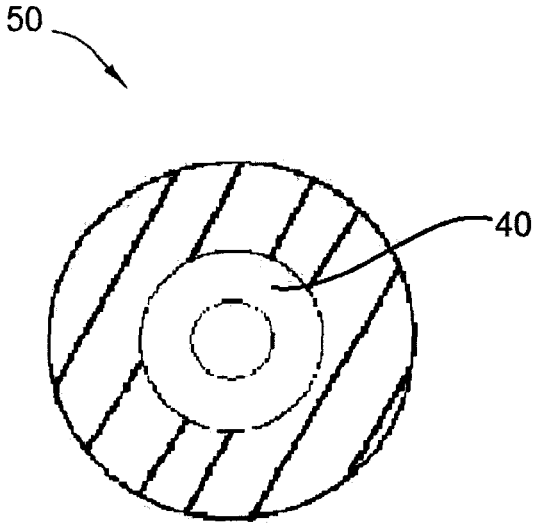
FIG. 3 is a sectional top view of an embodiment for a support structure.
Figure 4:
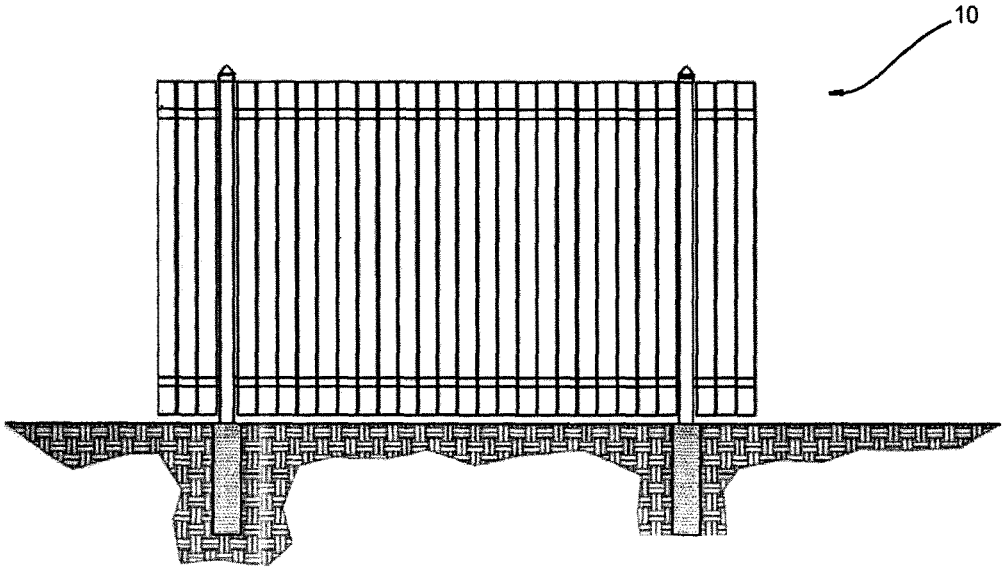
FIG. 4 is a back elevational view of a portion of the fence shown in FIG. 4 according to an embodiment of the invention.
Figure 5:
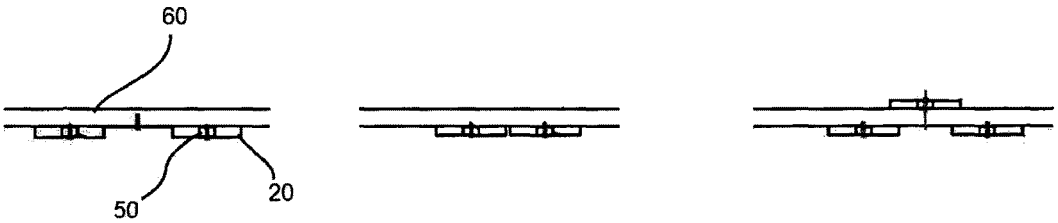
FIG. 5 is a top view of the fence in FIG. 4

Referred in FIGS. 1-4, the fence 10 includes a series of fence pickets 20 positioned between the top and bottom fence rails 60. The illustrated fence pickets 20 are vertical but the members can be arranged horizontally, diagonally or in other positions that may be desired. The fence pickets 20 can be selectively and readily adjusted to change the use, function, or appearance of the fence 10 as shown in FIGS. 4 and 5.

Figure 11:
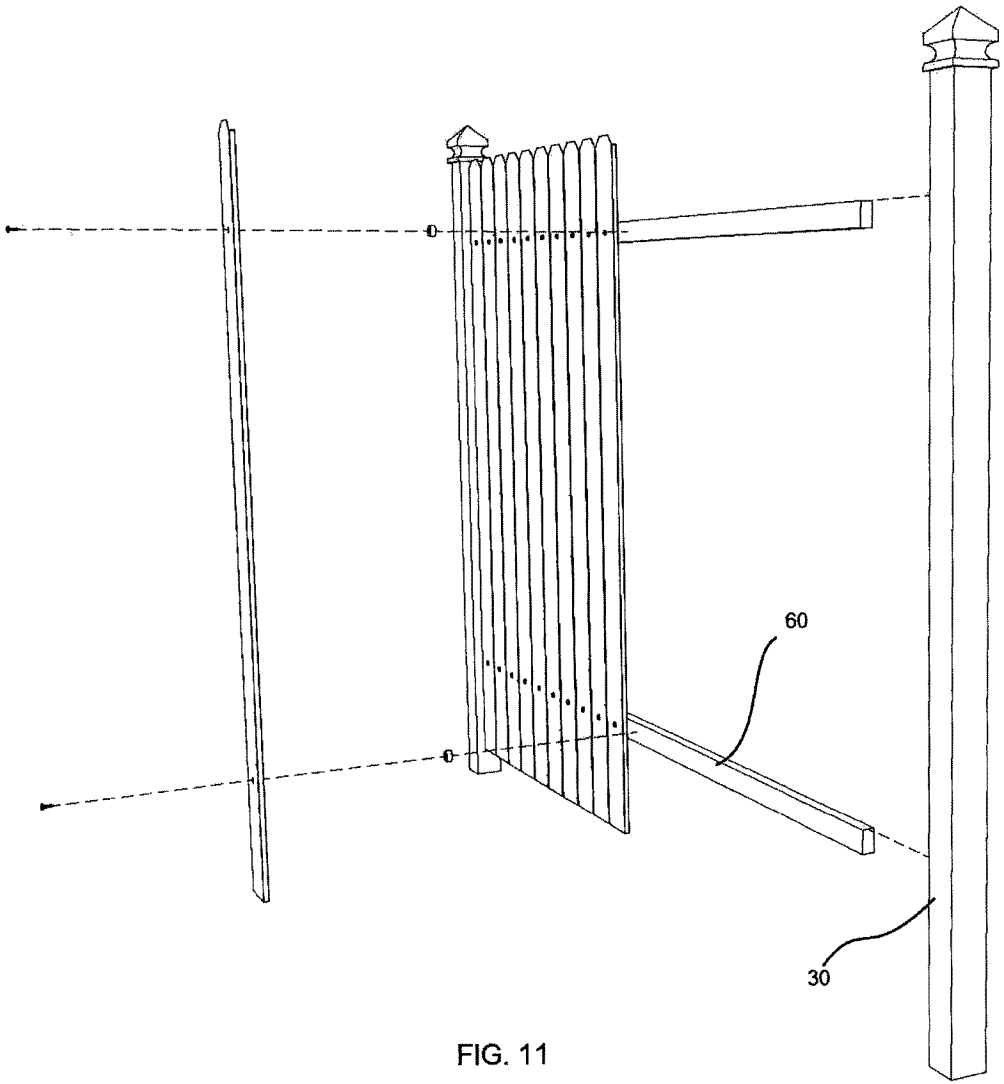
FIG. 11 is a perspective elevational view of the pickets that may be used to form the fence panel shown in FIG. 1
Figure 10:
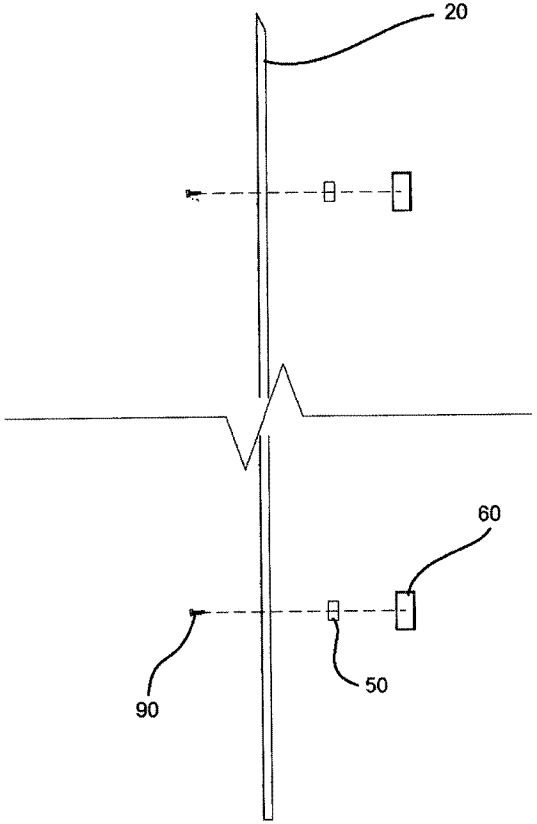
FIG. 10 is a cross-sectional view of a picket, prior to its assembly into a fence rail.
Figure 12A:
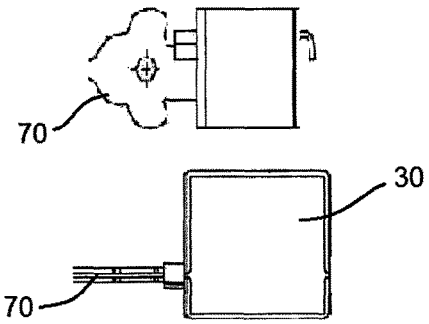
FIG. 12A-12E is an example method for assembling a bracket having multiple examples bracket-post attachments.
Figure 12D:
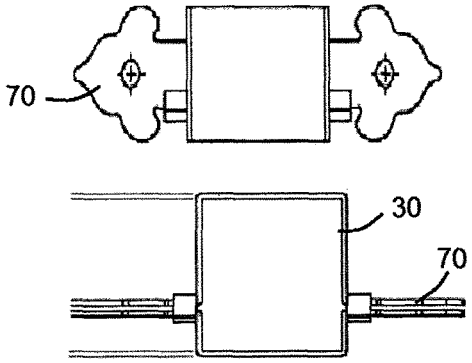
Figure 12B:
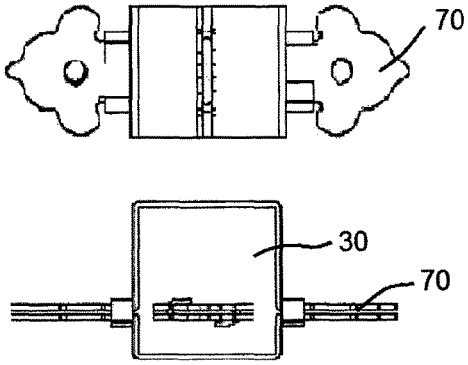
Figure 12E:
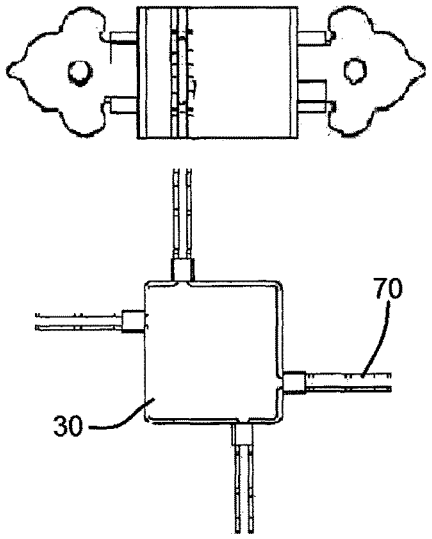
Figure 12C:
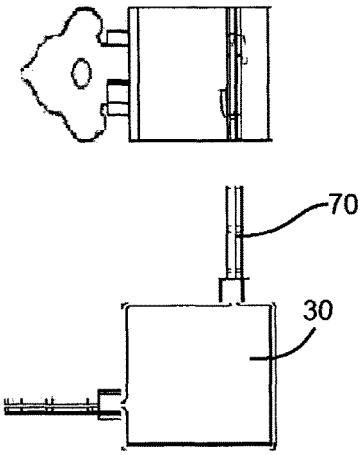

FIGS. 2 and 3 illustrate an embodiment of a support structure 50 associated with each of the fence pickets 20. As seen in FIG. 2, the top end of this support structure 50 is provided with an openable top portion 40 which can be used for a fastening member to pass through. The support structure 50 can be made of rubber or any materials that is suitable. The fastening member includes a threaded fastener which is secured by a friction fit, screwed or other suitable means to an aperture provided on each of the fence picket 20. Grooves or retaining surfaces can be provided to engage with the fence rails and assist in securing this fastening member in the rails to support the fence pickets as seen in FIGS. 10 and 11.

Figure 6:
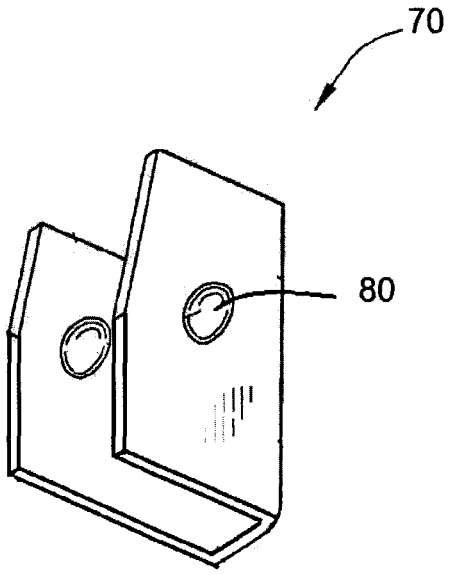
FIG. 6 is a perspective view of another embodiment of a bracket for an adjustable structure which be used to form a fence panel in FIG. 1.
Figure 7:
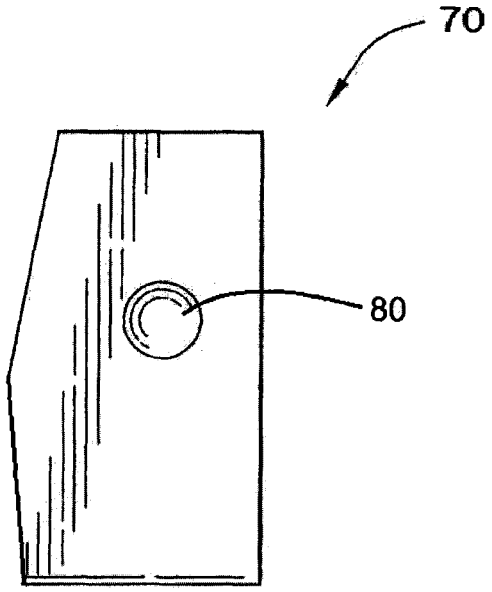
FIG. 7 is a front elevational view of the bracket shown in FIG. 6.

FIGS. 6 and 7 illustrate a bracket 70 comprising a brace section that is preferably characterized by a U-shaped cross section. The opposed side walls of the brace section are preferably disposed in spaced and parallel relationship. The height of the each side wall preferably approaches, but is slightly less than, the height of the fence rails 20. This sizing permits the bracket 70 to be fully received within the rail channel, with side walls of the bracket 70 and the rails 20 in contact, as shown in FIG. 8.

Referred to FIGS. 6-9, the bracket 70 may be welded, bolted, screwed, riveted, or otherwise attached to a portion of the fence post 30 in any suitable manner. An opening 80 defined by the opposed side walls of the brace section may be used for the connection component to pass through the aperture of the opening 80 and the fence rails 60. Connection component may be screwed, riveted, or otherwise attached to a portion of fence rail 60 located inside the bracket 70 in any suitable manner.

Figure 8:
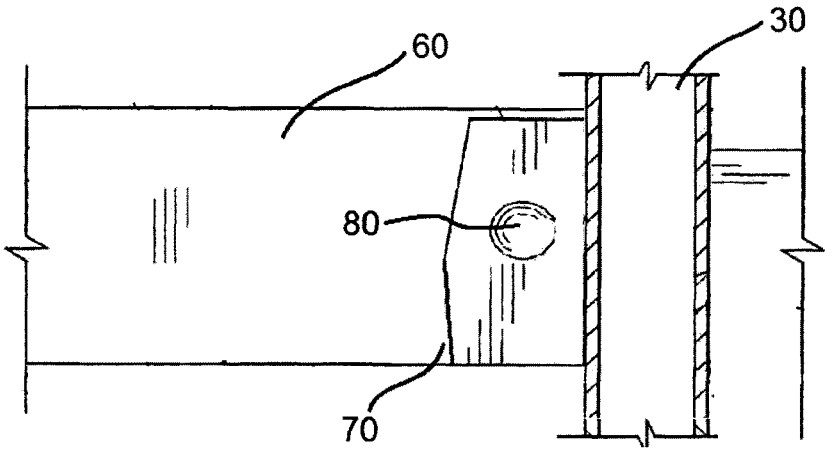
FIG. 8 is a cross-sectional view of a fence rail used to form the fence panel shown in FIG. 1, in an assembled state with the bracket of FIG. 6.
Figure 9:
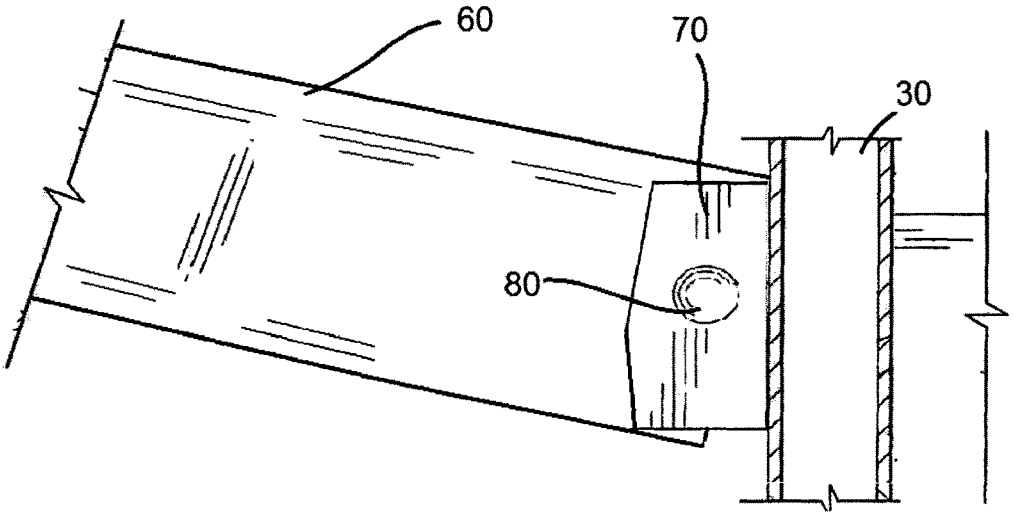
FIG. 9 is a cross-sectional view of the assembled fence rail, bracket and fence post shown in FIG. 8, showing the fence rail in a tilted relationship to the bracket.

Referred to FIGS. 8 and 9, the fence rail 60 is inserted into the bracket 70 such that the side walls of the brace section contact the rail, and such that the fence rail 60 traverses the rail channel in transverse relationship thereto. The bracket 70 is then mechanically secured to the rail 60, preferably at one or more connections formed between the side walls of the brace section through the opening 80. The connection may be formed by a fastener such as bolt or screw.

Referred to FIG. 9, after assembly with the bracket 70, the rail 60 may selectively tilted around the rectilinear connection component, with the connection component functioning as a hinge. The upper fence rail which is secured to the bracket 70, is accordingly tillable with respect to the lower fence rail within an angular adjustment range. This angular adjustment range extends on only a single side of a transverse plane orthogonal to the upper fence rail.

Once the fence rail 60 is positioned in the desired location through the rotation about the vertical axis, the connection component can be advanced on the threaded portion against the rail 60 to lock the fence rail 60 in the selected position. If it is later desired to move the fence rail 60 into a different selective position, the connection component can be unthreaded to release the fence rail 60 and permit the rail to once again rotate. In this manner, the fence 10 can be adjusted into a variety of orientations between the upper fence rail and the lower fence rail to adapt changes of terrain.

FIGS. 10-11 illustrate the fence pickets 20 in assembled state with the fence rails 60 for illustrative purposes. As seen in FIG. 10, each fence picket 20 is movably supported on the fence rails 60 by the support structures 50. The illustrated fence includes two fence rails but it will be appreciated that additional rails can be provided on the fence 10. The fence rail 60 can be provided with a metal tube runner which provides a channel through which components such as electrical wiring, air lines or the like can be extended to communicate between the inside hollow portions of the rails.

FIGS. 12A-12E illustrate bracket 70 which can be attached at the upper and lower portion of the post 30. The illustrated bracket 70 can be arranged for multiple connections stylist designs, such as two-way inline connection, two-way L shaped connection, three-way connection, and four-way connection. The bracket 70 can be selectively and readily adjusted to change the use, function, or appearance of the fence 10 as shown in FIGS. 12A-12E.

The embodiments were chosen and described to best explain the principles of the invention and its practical application to persons who are skilled in the art. As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above described exemplary embodiments, but should be defined only in accordance with the following claims appended hereto and their equivalents.

Having illustrated and described the principles of the present invention in a preferred embodiment, it will be apparent to those skilled in the art that the embodiment can be modified in arrangement and detail without departing from such principles. Any and all such embodiments are intended to be included within the scope of the following claims.

What is claimed is:

1. An adjustable and rackable picket fence comprising:

(a) a plurality of fence rails including an upper hollow fence rail and a lower hollow fence rail for supporting a portion of the picket fence;

(b) a plurality of vertical hollow fence posts;

(c) a plurality of vertical metal fence pickets, each of the fence pickets comprising a central wall having opposing front and rear surfaces and a pair of opposing vertical sidewalls extending along opposing longitudinal side edges of the central wall and defining a hollow channel therebetween, wherein the metal fence pickets have an embossed wood texture, and wherein each fence picket comprise a plurality of holes extending through the central wall thereof which are vertically spaced to correspond to the plurality of fence rails;

(d) a plurality of rubber washer-shaped support structures, wherein each of the support structures is disposed between a respective one of the metal fence pickets and one of the upper fence rail and the lower fence rail within the channel of the fence picket, and wherein each of the support structures comprises an aperture extending between front and rear surfaces thereof which is aligned with a respective hole of the fence picket for a fastener to pass therethrough, the aperture having a counter-bored top portion to facilitate axial-compression of the support structure;

(e) a plurality of fasteners, wherein each fastener extends through a respective hole of one of the fence pickets and an aligned aperture of a corresponding support structure, and is fastened to a respective one of the fence rails, wherein each of the fence pickets is rotatable about the fasteners and selectively adjustable to a plurality of tiltable positions, and wherein the fastener clamps the fence picket against the fence rail such to axially compress the support structure therebetween to frictionally retain the fence picket at a desired angular position relative to the fence rail; and (f) a plurality of U-shaped brackets for securing each of the fence rails to each of the fence posts, wherein each of the brackets has a brace section for holding an end of a respective one of the fence rails and an opening receiving a connection component therethrough pivotably affixing the bracket to the fence rail, wherein a height of each of the brackets is slightly less than a height of each of the fence rails for the fence rails rotate around the connection component, and wherein each bracket functions as a hinge to allow the fence rail to tilt at an angular adjustable range about a horizontal axis.

2. The adjustable and rackable picket fence of claim 1 wherein the fastener is selected from a group consisting of bolts, screws, pivots, and any combination thereof.

3. The adjustable and rackable picket fence of claim 1 wherein each bracket is adapted to engage and releasably lock the associated fence post in a selected position with respect to the fence rails.

4. The adjustable and rackable picket fence of claim 1, wherein the plurality of metal fence pickets are assembled in a plurality of fence panels.

5. The adjustable and rackable picket fence of claim 4, wherein the fence panels further comprise lock elements for locking and unlocking the fence panels into the fence posts.

6. The adjustable and rackable picket fence of claim 1, wherein the connection component is a fastener comprising a bolt or screw.

* * * * *